United States Patent [19]

Doshi

[11] Patent Number: 4,646,937

[45] Date of Patent: Mar. 3, 1987

[54] DISPENSING CARTONS FOR STACKS OF MILK FILTERS

[75] Inventor: Dilip D. Doshi, Roswell, Ga.

[73] Assignee: Kimberly-Clark Corporation, Neenah, Wis.

[21] Appl. No.: 664,280

[22] Filed: Oct. 24, 1984

[51] Int. Cl.[4] ..... B65H 1/08; B65D 5/72

[52] U.S. Cl. ..... 221/56; 221/255; 221/279; 229/17 B; 206/817

[58] Field of Search ..... 221/56, 259, 279, 280, 221/241, 242, 302–305, 311, 312 R, 312 C, 52, 57, 50, 56, 58, 59, 257, 240, 244, 260, 261, 255; 312/50, 61, 60, 71; 229/17 B, 17 R; 206/817, 804, 44.12, 526; 211/51

[56] References Cited

U.S. PATENT DOCUMENTS

| | | | |
|---|---|---|---|
| 546,849 | 9/1895 | Hughes | 221/56 X |
| 1,566,445 | 12/1925 | Stringer | 221/260 |
| 2,544,501 | 3/1951 | Johnson | 221/305 X |
| 2,801,769 | 8/1957 | Will | 221/260 |
| 2,928,571 | 3/1960 | Caruso | 221/255 X |
| 2,965,264 | 12/1960 | Silvia | 221/257 |
| 3,174,643 | 3/1965 | Carlson | 221/259 X |
| 3,278,080 | 10/1966 | DiLuco | 221/305 X |
| 3,450,308 | 6/1969 | Schoenefeld | 229/17 B |
| 3,679,096 | 7/1972 | Musser | 221/56 |
| 4,170,325 | 10/1979 | Pawlowski et al. | 221/312 X |

FOREIGN PATENT DOCUMENTS

| | | | |
|---|---|---|---|
| 1226484 | 10/1966 | Fed. Rep. of Germany | 221/311 |
| 308183 | 2/1969 | Sweden | 221/279 |
| 481003 | 3/1938 | United Kingdom | 221/255 |
| 1036718 | 7/1966 | United Kingdom | 221/311 |
| 1380676 | 1/1975 | United Kingdom | 221/52 |

*Primary Examiner*—Joseph J. Rolla
*Assistant Examiner*—Gregory L. Huson
*Attorney, Agent, or Firm*—William D. Herrick

[57] ABSTRACT

An improved dispensing carton for elongated flat articles such as milk filters is disclosed. The carton is of generally rectangular configuration and in preferred embodiments is adapted to dispense such elongated articles end-wise and one-at-a-time. Included within the container is a self-supporting member having a pull means that may be accessed through the dispensing opening. When the stack of articles is depleted to the point where access through the dispensing opening is difficult, the pull member may be slid forward carrying the remaining articles towards the dispensing opening and making them readily available. In a preferred embodiment resilient highly frictional foam tape is placed on the interior of a major panel and contacting the edges of the articles to be dispensed. Thus the articles other than the one actually dispensed tend to resist displacement and facilitate one-at-a-time dispensing. The container may be formed from conventional cartonboard or corrugate or from plastic materials. Alternative disclosed embodiments include wall mounting adhesive strips and an additional wedge-shaped insert to urge the contents towards the dispensing opening. In the preferred embodiment as a milk filter container, the invention provides improved access and convenience and may be used in conjunction with existing permanent dispensers.

6 Claims, 6 Drawing Figures

DISPENSING CARTONS FOR STACKS OF MILK FILTERS

BACKGROUND OF THE INVENTION

1. Field of the Invention

The present invention is directed to containers for elongated flat articles such as milk filters used to remove impurities from milk as it is being produced. More particularly it is directed to such containers that may be used not only as cartons in which the filters are sold but also which may be used alone or in conjunction with dispensers for housing the carton and contents and dispensing the milk filters, preferably one-at-a-time. The dispensing container of the present invention will find other applications as well wherever it is desired to maintain stacks of flat articles and conveniently dispense them end-wise one-at-a-time.

2. Description of the Prior Art

Milk filters are generally formed as elongated flat articles either in the form of a tube or a sock wherein the tube is closed at one end. A filter coil is inserted into a filter, and the milk is pumped from the outside through the filter fabric, forced through from the inside of the coil and directed through tubing or the like for further processing. The filter fabric removes impurities or other undesirable contaminants. These filters are generally elongated and have dimensions in the range, for example, of from about six to thirty-six inches in length and two to five inches in width and frequently formed of nonwoven material in a flat configuration. Such filters are well known and described, for example, in U.S. Pat. No. 4,292,180 to Zylka and Witte dated Sept. 29, 1981. In use the filters are changed as infrequently as twice per day but, depending upon the size of the dairy, multiple milking machines may be required. Also, if a filter should break, it must be replaced promptly to avoid further contamination. Accordingly, dairies maintain a supply of milk filters on hand, and they must be available for ready access. Since these filters are used singularly per milking machine, it is most convenient for them to be dispensed one-at-a-time.

Milk filters are available conventionally as stacks containing up to about one or two hundred or more individual filters. These stacks are supplied in a carton or wrapper that can be placed within a permanent container of metal or the like located convenient to the milking machine. This container may be positioned to maintain the stack flat on one of its major surfaces, but, more commonly, it is arranged so that the filters are disposed end-wise and dispensed by pulling a filter through an opening in the bottom or bottom front corner of the permanent container which may be affixed to the wall or other convenient surface. However, in order to avoid contamination of the filters within the container the dispensing opening is desirably small and may be closed when dispensing is not needed. Particularly when the stack has been substantially depleted, this has made such end-wise dispensing difficult since it is then necessary to reach into the container to grasp the next filter. Therefore, there remains desired a carton or dispensing means for milk filters that improves accessibility to the filters particularly when the stack of filters is partially or substantially depleted. Also, since the filters may become contaminated if prematurely removed from the dispenser, it is desirable to provide for one-at-a-time dispensing of the filters, and improvements in dispensing cartons or containers that would facilitate such one-at-a-time dispensing.

SUMMARY OF THE INVENTION

The present invention is directed to an improved dispensing carton for elongated flat articles such as milk filters. The carton comprises a container having top and bottom panels, two major side panels and two minor side panels, the size being adapted to enclose a stack of desired dimension of the articles. The container includes a dispensing opening in or adjacent the bottom panel for dispensing the articles positioned on end and in an end-wise manner. Included within the container is a self-supporting member behind the last of the articles to be dispensed and a pull member extending between the self-supporting member and the opening and adapted when pulled to urge the stack of elongated articles toward the opening and facilitate dispensing. In a preferred embodiment the container also includes resilient slip-resistant means on the interior of at least one major side panel and adapted to contact the edges of the flat articles to resist displacement of the articles and facilitate one-at-a-time dispensing. In operation, the container may be used in the manner of conventional containers until the stack is somewhat depleted and access to the next article is not readily available. By pulling the tab on the pull member the stack is moved toward the opening and the next article to be dispensed is readily available. Also the slip-resistant means provides a slight force against displacement that works to hold the remaining articles in place. Preferred embodiments for the slip-resistant means include foam tape or other resilient materials having a high frictional coefficient. The pull member and carton may be formed from conventional container materials such as cardboard, plastic, or the like. Applications for dispensing articles other than milk filters will be apparent but the invention finds most utility where such articles are thin and flexible.

DESCRIPTION OF THE PREFERRED EMBODIMENTS

Figure 1:
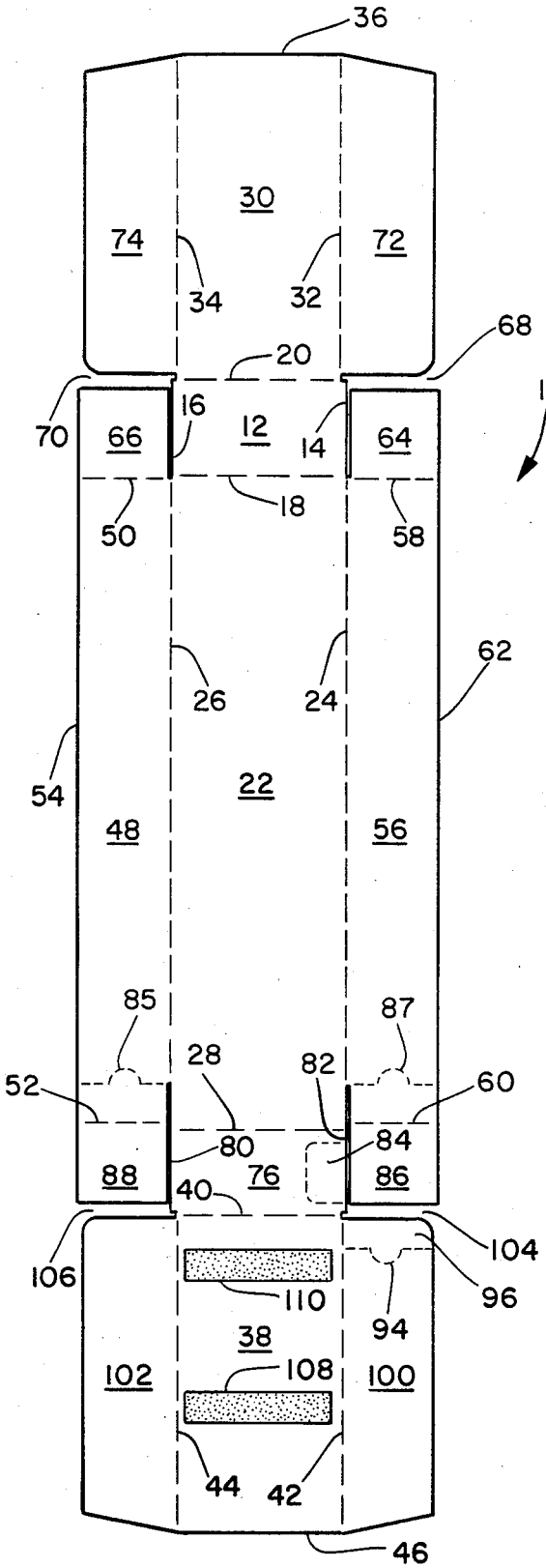
FIG. 1 is an illustration of a container blank in accordance with the invention.

While the present invention will be described in connection with dispensing containers for milk filters, it will be apparent to those skilled in the art that it will also find utility in dispensing cartons for other elongated articles where end-wise dispensing is desired such as, for example, tongue depressors for medical or dental uses or beauty coils for barber and hairdresser use. In particular, it is useful where such articles are flexible and non-self-supporting since such articles tend to dispense with greater difficulty when the stack of articles is somewhat depleted.

While the material of which the container is constructed will vary depending upon the particular use intended, for the milk filter application it is preferably of low cost consistent with disposability since such filters are used once then discarded. For this application, the material is preferably of carton board or corrugate of a basis weight providing a burst strength generally in the range of up to about 250 lbs/in$^2$ and/ preferably, in the range of about 150 to 200 lbs/in$^2$. Alternatively, plastic may be used having the desired degree of strength and protection properties but corrugate board such as "C" flute grade is preferred for strength considerations as well as for processing purposes. Such and other suitable materials are further described, for example, in "Fibre Box Handbook" Copyright 1976, Fibre Box Association as reprinted by Container Division, International Paper Company, at pages 19–25, which is incorporated herein by reference.

The pull member may be formed of the same material as the container, however it may be different. For example, the strength requirements are not as great, and it may be "B" flute construction. The pull member is self supporting, particularly for the milk filter application where it will act as a support for the flexible filters. As with the container, it is preferably a cardboard or a corrugate material but may be of plastic as well. The pull tab may be integral with the pull member or it may be attached thereto by separate attachment means. While it may be in the form of a string or a tape, since the stack of articles is resting on the tab and not supported thereby, for cost reasons, it is preferably a part of the pull member itself formed simply by folding the member along the bottom of the container. The tab member extends into or is immediately adjacent the opening provided in the bottom or bottom side portion of the container so that it may be easily grasped when desired. The opening may be of a desired size to accommodate the reach of the user but is preferably minimized so as to avoid excessive exposure to possible contamination. When the container is used in connection with a mounted or other permanent dispenser, the opening will coincide with the opening of that outer container or dispenser.

Assembly of the container of the invention may be by various means such as adhesives, or the like. Staples or other fasteners may be used, but for the application for milk filters such fasteners that may puncture or otherwise damage the contents are avoided. Alternatively, particularly when formed of plastic, the container may be integral and formed as a single piece by injection molding or other such processing steps. While the pull member may be formed integrally with the container, for economy, it is preferably formed separately and enclosed within the container as shown and described with respect to the drawings.

The slip resistance means is a material approved for contact with milk filters for that application and is preferably resilient, for example, a foam material of high frictional coefficient such as polyethylene foam ¾" wide. Such a tape is self-adhering and may be applied in a single or multiple strips and serves to resist premature displacement of the elongated articles other than the one actually being dispensed. This facilitates one-at-a-time dispensing. Other materials such as multiple layers of creped wadding or other soft materials with appropriate strength properties alone or with reinforcing backings may be used. The material is attached by adhesive to the inside to one of the major surfaces of the container so as to contact the edges of the articles being dispensed. While use of the slip resistant material on only one major surface is sufficient for dispensing of milk filters, the slip resistant material may be provided on the other major inside surface as well if desired.

Turning to the figures, the invention will now be described in further detail with reference to a dispensing container for milk filters. Such filters are generally flexible, flat and nonself-supporting and formed from fabrics such as nonwoven materials having the ability to permit passage of the milk while blocking passage of contaminants such as dirt, straw and so forth. For clarity the filter contents 136 are illustrated only in broken away portions of the drawings and in position for dispensing. As shown in FIG. 1, the container may be formed from a cardboard or corrugate material and have a configuration that is generally rectangular. Carton blank 10 includes top panel 12 defined by cut lines 14 and 16 and fold lines 18 and 20. One major surface panel 22 is defined by fold lines 18, 24, 26, and 28. The other major panel surface is defined by panels 30 (formed by fold lines 20 32 and 34 and end line 36) and panel 38 defined by fold line 40, 42, and 44 and end line 46. Panel 48 will form the closed or rear wall panel and is defined by fold lines 26, 50, and 52 as well as side edge 54. The other minor panel, forming the front surface, 56, is defined by fold lines 24, 58, and 60 as well as side edge 62. Tabs 64 and 66 cooperate in forming the top surface when folded along lines 58 and 50 respectively. Slits 68 and 70 are included to facilitate forming these folds. Also, panels 72 and 74 when folded along lines 32 and 34, respectively, cooperate in forming the front and rear of the carton. Bottom or dispensing panel 76 is formed by fold lines 40 and 28 as well as cut lines 80 and 82. Cut line 82 includes cut-out portion 84 formed by removal of part 83 which serves as the dispensing opening. Tabs 86 and 88 defined also by. cut lines 85, 87 are preferably removed prior to inserting the filters (see FIG. 3). Additional cut line 94 serves to displace the bottom panel portion 96 and increase the access to the dispensing opening 84 after removal of panel 86. Panels 100 and 102 also cooperate to form the front and rear panels when folded along lines 42 and 44, respectively. Slits 104 and 106 are included to facilitate folding of the carton blank 10. For the preferred embodiments, foam strips 108 and 110 are secured to panel 38 and serve to contact the edges of these filters and facilitate one-at-a-time dispensing.

Figure 2:
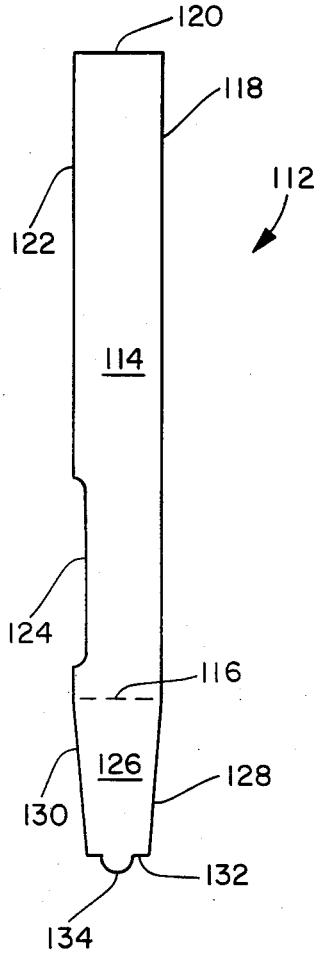
FIG. 2 is an illustration of a blank for pull means with accordance with the blank of FIG. 1.

Turning to FIG. 2, the pull means will be further described. Pull member 112 may comprise a strip having panel 114 formed by fold line 116 and edges 118, 120 and 122. The length of panel 114 is selected to correspond generally to the length of panel 48 although it is preferably slightly less to facilitate easy insertion. Similarly, the width of panel 114 is preferably slightly less than the width of panel 48 to facilitate insertion. Cut out 124 in edge 122 is provided to accommodate the foam strips 108, 110. Panel 126 formed by fold line 116 and edges 128, 130 and 132 serves as the pull tab and preferably includes projection 134 which, in use, will be exposed through opening 84 and facilitate grasping of the tab panel 126.

Figure 3:
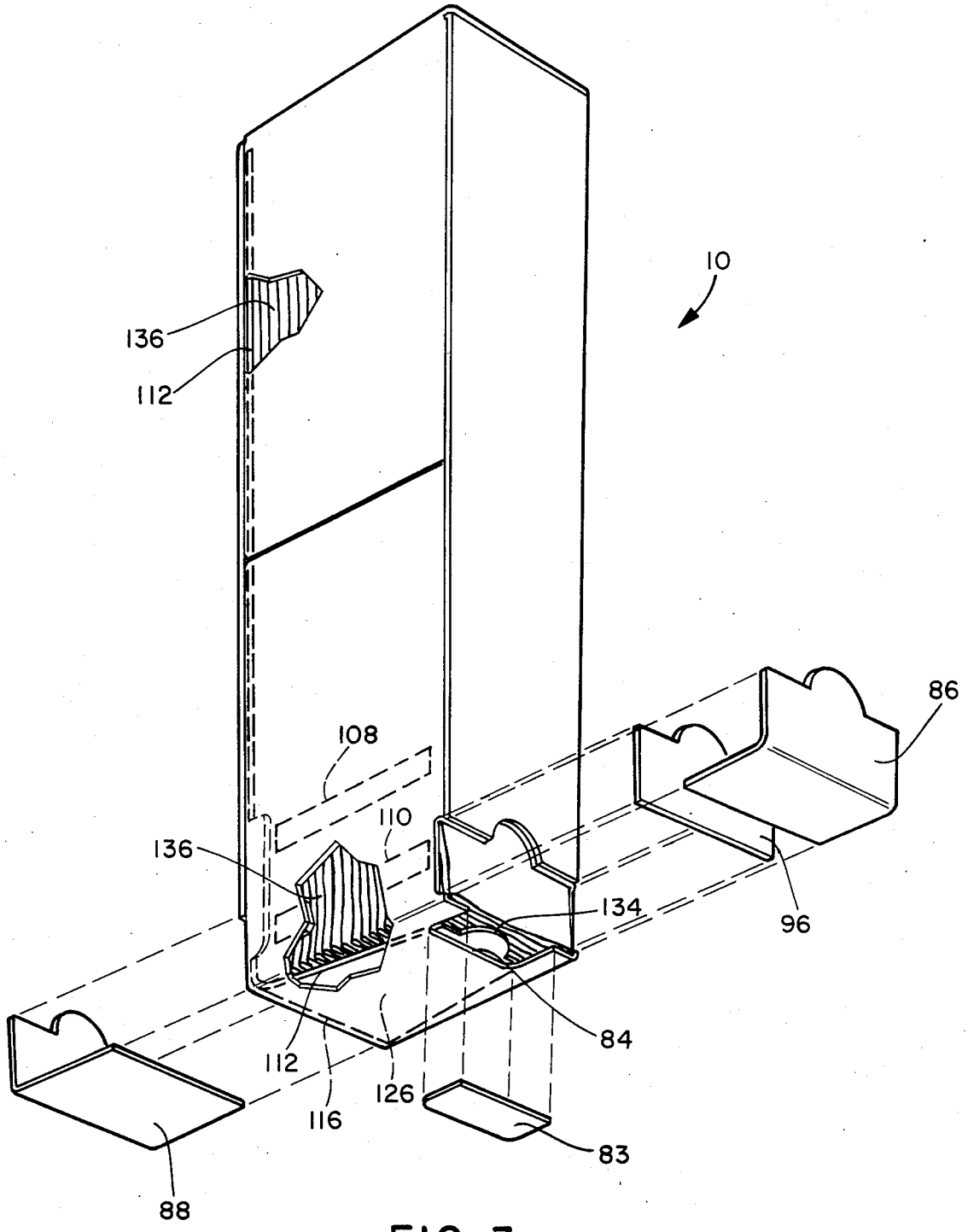
FIG. 3 illustrates the container of FIG. 1 with portions removed and ready to use for milk filters.

Turning to FIG. 3, carton flap 10 is shown assembled and containing filters 136. To assemble the carton after filters are inserted, blank 10 is first folded along fold lines 24, 26 and end panels along 50, 58 to form the top and minor panels. Then the closure is formed by folding along lines 18, 20, 28 and 40. The panels 84, 86, 88, 96 will be removed prior to dispensing. The pull member 112 may be folded along line 16 and inserted, preferably prior to completing the formation of carton 10 and prior to inserting the carton contents 136. As shown in phantom in FIG. 3, in the cross-section, pull member 112 is positioned behind filters 136 and tab member 126 extends underneath the filters and is partially exposed by opening 84. While only a single pull member is illustrated, if the number of articles is sufficiently great that moving with a single pull member is difficult, multiple pull members may be inserted at spaced locations within the articles 136. In such case, when the contents moved by one pull member is depleted, that pull member may simply be removed and discarded and the next pull member then employed.

Figure 4:
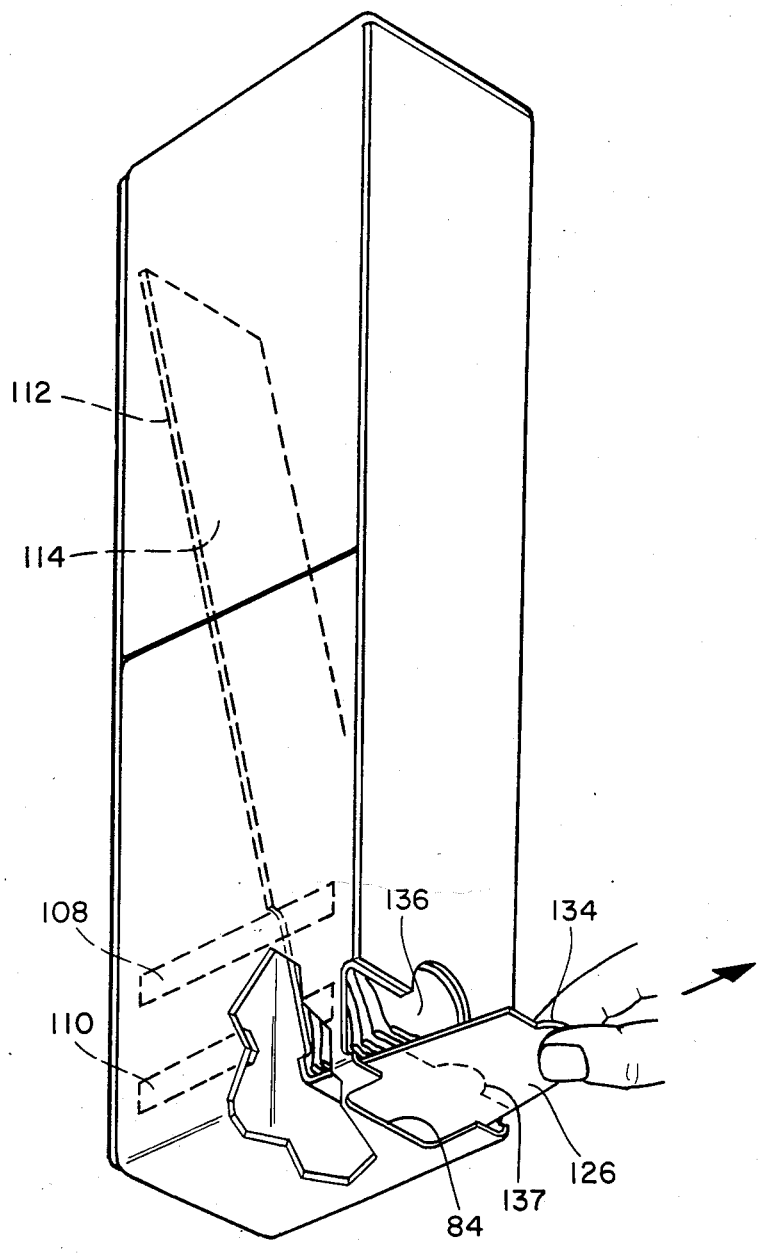
FIG. 4 is an illustration similar to that of FIG. 3 where a stack has been substantially depleted and the pull means employed to provide access to the remainder of the stack.

Turning to FIG. 4, the pull member 112 is shown with the contents of 136 partially depleted and having been moved forward for accessibility by means of the pull member tab 126. This exposes foam strips 108 and 110 which continue to contact the remainder of contents 136. To further facilitate use of the pull member 112, it may be desired to apply a lubricating coating such as wax to the sliding surfaces of tab 126 and/or bottom panel 76. In any event, it is desired that these surfaces be such that they readily permit sliding of pull tab 126.

While the dispensing container has been described with respect with a specific configuration, it will be apparent that many variations may be employed. It will also be apparent that the benefits are obtained to the greatest extent where the container is generally rectangular in shape and where the major surfaces are verticaly disposed such that the articles to be dispensed are resting on end and available for end-wise one-at-a-time dispensing. The blank for the container may take a wide variety of forms and the container may even be formed as a single piece from plastics by injection molding or other plastic forming procedures. Also pull tab 126 need not be an integral part of member 112 but may be a ribbon, string, or the like attached thereto and adapted to apply a pulling force against panel 114 which will operate to adjust the position of contents 136.

In some cases the pull member panel 124 may be of such a length that it protrudes undesirably from opening 84 once the contents 136 have been substantially depleted. In such a case, perforations 137 along the length of panel 126 (FIG. 4) may be provided so that the panels may simply be torn to reduce the degree of protrusion or the panel 126 may simply be cut if made of a suitable material.

Figure 6:
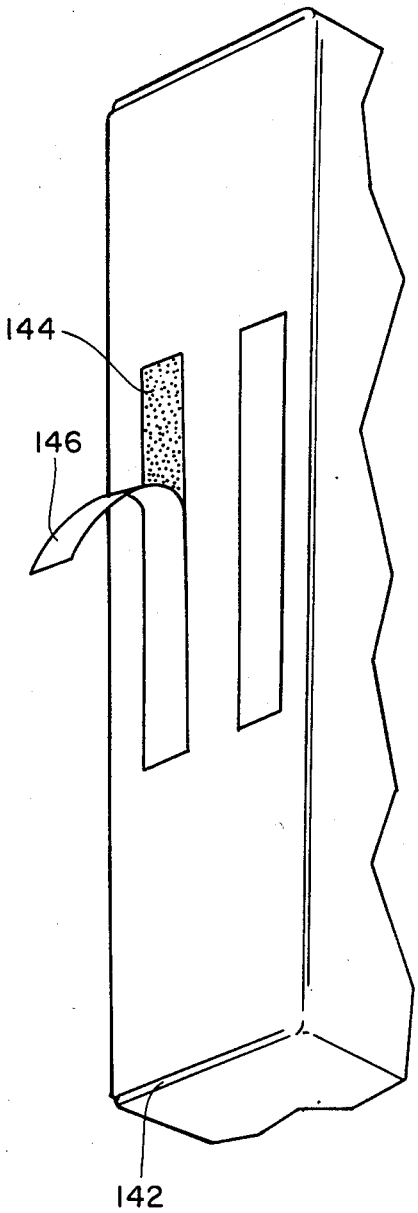
FIG. 6 is a partial view of the back panel of the container embodiment having adhesive means for attaching the container to a convenient surface.

Depending upon the desired use, the container may be discarded after the contents have been used in which case it may be desirable to adapt it to fit within permanent dispensers such as are currently available for products like milk filters. Alternatively, the container may be, itself, permanent and adapted to be attached to walls or the like for convenient dispensing. In yet another alternative the carton may be disposable but have an adhesive attachment means such as strips 139 (FIG. 6) to serve as the dispenser without making use of a permanent container. Other variations will be apparent to those skilled in the art.

Figure 5:
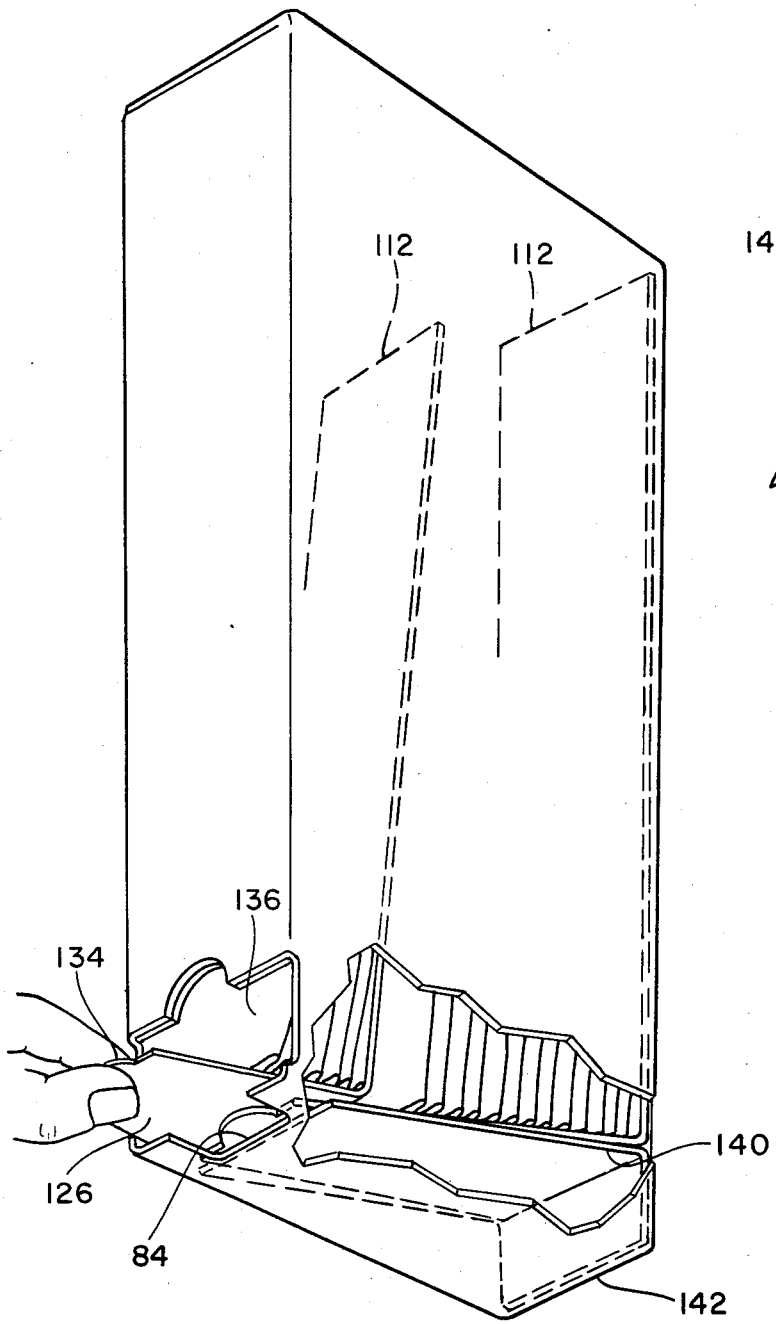
FIG. 5 is an illustration like that of FIG. 4 depicting an embodiment wherein multiple pull means are used.

Turning to FIG. 5, an alternative embodiment is shown in perspective from the rear. In this configuration an additional wedge-shaped insert 140 is included with its high end at lower rear corner 142. This insert also urges contents 136 towards opening 84 and thereby further improves accessibility and enhances the performance of pull member 112. This wedge may be formed of any convenient material and will normally be discarded with the carton. Selection of the angle for the wedge will be a function of carton size and degree of assistance desired as will be apparent to those skilled in this art. This embodiment also illustrates the case where multiple support members 112 may be employed where the stack is of greater dimensions, for example. In the embodiment shown partially in FIG. 6 attachment means in the form of pressure sensitive adhesive strips 144 covered by release strips 146 are shown as exemplary of devices that may be used on the exposed surface of back panel 48 to position the carton on a wall or other location for convenient dispensing.

Thus it is apparent that there has been provided in accordance with the invention, a dispensing carton that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

I claim:

1. A carton for dispensing elongated fat milk filters comprising, a container having an interior surface and exterior surface formed by a top panel, a bottom panel, two major side panels and two minor side panels and adapted to enclose a stack of elongated, flat milk filters disposed endwise, a dispensing opening in or adjacent said bottom panel for vertically dispensing said milk filters in a endwise manner, a self-supporting member of at least "B" flute strength following the last of said milk filters to be dispensed and a movable pull member extending from said self-supporting member and towards said opening and adapted upon pulling to urge said elongated milk filters toward said opening to facilitate dispensing and a wedge shaped insert fixedly mounted on said bottom pannel adapted to urge said milk filters toward said dispensing opening.

2. The dispensing container of claim 1 wherein said pull member includes a tab portion having means to reduce the length of said tab projecting towards said opening.

3. The dispensing carton of claim 1 further including resilient, slip-resistant means on the interior surface of at least one of said major panels adapted to contact the edges of said flat milk filters to resist displacement of said milk filters and facilitate one at the time dispensing.

4. The dispensing carton of claim 3 wherein said resilient, slip-resistant means is a polyethylene foam.

5. The dispensing carton of claim 1 further including means for mounting said carton at a desirable location.

6. The dispensing carton of claim 5 wherein said mounting means comprises a pressure sensitive adhesive.

* * * * *